US009788638B2

(12) United States Patent
Robert et al.

(10) Patent No.: US 9,788,638 B2
(45) Date of Patent: Oct. 17, 2017

(54) OUTDOOR PACK WITH COMPANION FRAME

(71) Applicant: Plano Molding Company, Plano, IL (US)

(72) Inventors: Jay Robert, Star, ID (US); Timothy S. Makos, West Bend, WI (US)

(73) Assignee: Plano Molding Company, Plano, IL (US)

( * ) Notice: Subject to any disclaimer, the term of this patent is extended or adjusted under 35 U.S.C. 154(b) by 44 days.

(21) Appl. No.: 14/588,027

(22) Filed: Dec. 31, 2014

(65) Prior Publication Data

US 2015/0196110 A1 Jul. 16, 2015

Related U.S. Application Data

(60) Provisional application No. 61/926,100, filed on Jan. 10, 2014.

(51) Int. Cl.

| | |
|---|---|
| ***A45F 3/08*** | (2006.01) |
| ***A45F 3/10*** | (2006.01) |
| *A45F 4/02* | (2006.01) |

(52) U.S. Cl.

CPC ..... *A45F 3/08* (2013.01); *A45F 3/10* (2013.01); *A45F 2004/026* (2013.01)

(58) Field of Classification Search

CPC ..... A45F 3/08; A45F 2004/026
USPC ..... 224/153, 644, 633–636
See application file for complete search history.

(56) References Cited

U.S. PATENT DOCUMENTS

| | | | | |
|---|---|---|---|---|
| 2,570,571 | A * | 10/1951 | Leeman | A47C 4/52 190/109 |
| 2,620,479 | A | 12/1951 | Buck | |
| 2,678,447 | A | 5/1954 | Bracken | |
| 3,679,108 | A | 7/1972 | Ingram | |
| 4,074,839 | A * | 2/1978 | Wood | A45F 3/08 224/635 |
| 4,087,031 | A * | 5/1978 | Fenner | A45F 3/10 224/602 |
| 4,318,502 | A | 3/1982 | Lowe | |
| 4,530,451 | A | 7/1985 | Hamilton | |
| 4,669,127 | A | 6/1987 | Swanson | |
| 4,938,400 | A | 7/1990 | Springston | |
| 5,356,003 | A | 10/1994 | Gretz et al. | |
| D352,816 | S | 11/1994 | Kirn et al. | |

(Continued)

FOREIGN PATENT DOCUMENTS

| | | |
|---|---|---|
| GB | 2438584 A | 5/2007 |
| JP | 10-089591 | 4/1988 |
| KR | 10-0613622 | 8/2006 |

OTHER PUBLICATIONS

Canadian Intellectual Property Office, Office Action, Canadian Appln. No. 2,935,451, dated May 23, 2017.

*Primary Examiner* — Justin Larson
(74) *Attorney, Agent, or Firm* — McGuireWoods LLP

(57) ABSTRACT

A backpack system is described herein comprising a frame and a pack (e.g., backpack or outdoor pack) that may be used by individuals engaging in different type of events such as hunting, fishing, hiking, sports and the like. The pack may be configured to be readily engaged with the frame. The pack may comprise one or more pocket sections that may be quickly detached for easy access to its contents by a user while still wearing the main part of the pack which may remain engaged with the frame.

24 Claims, 15 Drawing Sheets

(56) References Cited

U.S. PATENT DOCUMENTS 5,381,936 A * 1/1995 Beery ..... A45F 3/04 224/153
D355,297 S 2/1995 Ash, Jr.
5,400,934 A 3/1995 Ducros
5,427,290 A 6/1995 Thatcher
5,433,358 A 7/1995 Millard
5,497,922 A 3/1996 Tate
D369,021 S 4/1996 Kliot
5,588,570 A 12/1996 Zirbel
5,639,005 A 6/1997 Chouinard
5,642,846 A 7/1997 Morrow
D386,887 S 12/1997 Hambas
D387,896 S 12/1997 Dewey
5,695,100 A * 12/1997 O'Brien ..... A47C 7/66 135/143
5,803,333 A 9/1998 Fawcett
5,842,614 A 12/1998 Morrow
5,862,967 A 1/1999 Johnson
5,882,079 A * 3/1999 Yang ..... A47C 1/146 297/228.1
5,909,802 A 6/1999 Puco et al.
5,913,409 A 6/1999 Test
5,927,575 A 7/1999 Gatling
5,975,387 A 11/1999 Gleason et al.
D418,673 S 1/2000 Madsen
D418,972 S 1/2000 Gold
D426,051 S 6/2000 Bugel et al.
6,135,333 A 10/2000 Tucker et al.
6,145,716 A * 11/2000 Caicedo ..... A45F 3/04 224/155
6,216,926 B1 4/2001 Pratt
6,243,892 B1 6/2001 Kelling
6,250,712 B1 6/2001 Livington et al.
6,295,650 B1 10/2001 Baacke
6,347,406 B1 2/2002 Jones et al.
6,422,439 B1 7/2002 Kelliher et al.
D465,638 S 11/2002 Reeves
6,547,110 B2 4/2003 O'Hare
6,568,575 B1 5/2003 Bartholomew
6,763,987 B1 7/2004 Eberle
6,772,925 B2 8/2004 O'Hare
6,843,398 B2 1/2005 Zion
6,889,834 B2 5/2005 Ho
6,892,915 B2 5/2005 Mares
D510,793 S 10/2005 Peterson
7,000,255 B1 2/2006 Baacke
D526,468 S 8/2006 Dingman et al.
7,117,539 B1 10/2006 Baacke
7,159,878 B1 * 1/2007 McKenna ..... A45C 5/14 280/47.26
7,232,049 B2 * 6/2007 Meyer ..... A45F 3/08 206/315.3
D550,448 S 9/2007 Boje
D552,845 S 10/2007 Shor et al.
D587,007 S 2/2009 Phillips, III
D603,157 S 11/2009 Hutchinson
D611,680 S 3/2010 Thomas
7,717,263 B2 * 5/2010 Evans ..... A63D 15/10 190/108
7,851,932 B2 12/2010 Rome et al.
D630,427 S 1/2011 McGuire
7,886,949 B2 2/2011 Fenton et al.
D641,973 S 7/2011 Quehl
D642,791 S 8/2011 Quehl
8,032,949 B1 10/2011 Matthews
8,047,411 B2 11/2011 Thatcher
8,113,396 B2 2/2012 Schilly
8,118,201 B1 2/2012 Calkin
8,123,581 B2 2/2012 Aschauer
8,157,138 B2 4/2012 Leyendecker
D665,573 S 8/2012 Crandall
D673,363 S 1/2013 Crandall
D699,940 S 2/2014 Robert
D699,941 S 2/2014 Robert
8,678,253 B2 * 3/2014 Graham ..... A45F 3/047 224/155
8,960,513 B2 * 2/2015 Crandall ..... A45F 3/04 224/576
D737,047 S * 8/2015 Robert ..... D3/217
2004/0149793 A1 8/2004 Theodore
2005/0120464 A1 6/2005 Clark
2005/0133399 A1 6/2005 Fidrych
2005/0188450 A1 9/2005 Clark
2005/0230445 A1 10/2005 Woo
2006/0081663 A1 4/2006 Chiang
2006/0213944 A1 9/2006 Dieter
2006/0239593 A1 10/2006 Fidrych
2007/0012734 A1 1/2007 Lee et al.
2007/0012735 A1 1/2007 Lee et al.
2007/0187444 A1 8/2007 Hajari
2008/0029562 A1 2/2008 Hawkins
2008/0029565 A1 2/2008 Enriquez
2008/0067203 A1 3/2008 Culhane
2008/0116026 A1 5/2008 Bass
2008/0122267 A1 5/2008 Larson et al.
2008/0156839 A1 7/2008 Betcher et al.
2009/0095784 A1 4/2009 Enriquez
2009/0127299 A1 5/2009 Jamlang
2009/0274398 A1 11/2009 Men
2010/0133303 A1 * 6/2010 Schilly ..... A45F 3/10 224/155
2010/0308086 A1 12/2010 Chapuis
2011/0000944 A1 1/2011 Hood
2011/0010818 A1 1/2011 Hood
2011/0099681 A1 5/2011 Imai et al.
2011/0180579 A1 7/2011 Richardson
2011/0186611 A1 8/2011 Eberle
2011/0290842 A1 12/2011 Esref et al.
2012/0000003 A1 1/2012 Matthews
2012/0031936 A1 2/2012 Hairston et al.
2012/0043357 A1 2/2012 Campbell
2013/0056510 A1 3/2013 Yun
2014/0239031 A1 8/2014 Robert
2015/0196110 A1 * 7/2015 Robert ..... A45F 3/10 224/633

* cited by examiner

OUTDOOR PACK WITH COMPANION FRAME

CROSS REFERENCE TO RELATED APPLICATIONS

This application claims priority to and the benefit thereof from U.S. Provisional Patent Application No. 61/926,100, filed on Jan. 10, 2014, titled "Outdoor Pack with Companion Frame," the entirety of which is hereby incorporated herein by reference.

FIELD OF THE DISCLOSURE

This disclosure is directed to an outdoor pack, and more particularly, to an outdoor pack for use in, e.g., outdoor activities, hiking, or hunting fowl such as turkey or other animals.

BACKGROUND OF THE DISCLOSURE

Hunters and/or outdoor enthusiasts must often spend long periods of time in a stationary position, remaining nearly motionless to avoid making noise, e.g., so as to not frighten the hunted animal, e.g., deer, rabbit, turkey, and the like. As such, outdoor enthusiasts or hunters often experience discomfort and fatigue from remaining in a same posture for a long time whether it is sitting or standing.

Outdoor packs are known that can be carried and may be used to relieve some of the pressure from the user such as hunters while they remain in a same pose e.g., sitting, standing, lying, and the like. However, none of them offer a strong back support while simultaneously allowing a hunter to remain in a same position for an extended time period.

There is an unfulfilled need for a portable outdoor pack that can offer the back support necessary for comfortable, long term positioning.

SUMMARY OF THE PRESENT DISCLOSURE

According to some aspects of the disclosure, a backpack system is described herein that may comprise a backpack that includes a storage section and a bracket cover and a portable frame. The portable frame may comprise a base, an adjustable support member, and a bracket that secures a portion of the adjustable support member to the base. The base and adjustable support member may be configurable between a compacted position and an extended position to provide a user with selectable support.

According to some aspects of the disclosure, the portable frame may comprise two support members, the support members being spaced apart from one another with the base interdisposed therebetween.

According to some aspects of the disclosure, the at least one support member may comprise a tubular member.

According to some aspects of the disclosure, the at least one support member may comprise a first sub-member and a second sub-member, the first sub-member and the second sub-member being telescopically joined, wherein the first sub-member slidably holds the second sub-member therewithin.

According to some aspects of the disclosure, the at least one adjustable support member is adjustable to an extended position, the extended position causing the base to be held at a moderate angle to provide a rest support for a wearer of the backpack system.

According to some aspects of the disclosure, a backpack system is described herein that may comprise a backpack having one or more storage sections and a portable frame removably attachable to the backpack, the portable frame comprising a base and at least one adjustable support member.

According to some aspects of the disclosure, the portable frame may comprise two support members, the support members being spaced apart from one another with the base interdisposed therebetween.

According to some aspects of the disclosure, the at least one support member may comprise a tubular member.

According to some aspects of the disclosure, the at least one support member may comprise a first sub-member and a second sub-member, the first sub-member and the second sub-member being telescopically joined, wherein the first sub-member slidably holds the second sub-member therewithin.

According to some aspects of the disclosure, the at least one adjustable support member may be adjustable to an extended position, the extended position causing the base to be held at a moderate angle to provide a rest support for a wearer of the backpack system.

According to some aspects of the disclosure, the base may comprise a collapsible structure comprised of two or more sub-rods telescopically joined together.

According to some aspects of the disclosure, the backpack may comprise at least one removable pocket, the at least one removable pocket being attachable to the portable frame.

According to some aspects of the disclosure, the backpack may comprise at least one removable pad, the removable pad being attachable to the backpack with at least one fastener.

According to some aspects of the disclosure, the backpack system may further comprise a fastening member, the fastening member connecting the first sub-member and the second sub-member, the fastening member being configured to adjust a length of the at least one support member.

According to some aspects of the disclosure, the at least one support member may be configured to hold the base in an upright position relative to the ground.

According to some aspects of the disclosure, the at least one support member may be adjustable to different angles.

According to some aspects of the disclosure, a frame for a backpack system is described herein comprising a base and at least one adjustable support member, wherein the at least one support member may be projectable substantially downward and rearward from the base and may be attachable to a portion of the base.

According to some aspects of the disclosure, the frame may further comprise two support members, the support members being spaced apart from one another with the base interdisposed therebetween.

According to some aspects of the disclosure, the at least one support member may comprise a tubular member.

According to some aspects of the disclosure, the at least one support member may comprise a first sub-member and a second sub-member, the first sub-member and the second sub-member being telescopically joined, wherein the first sub-member slidably holds the second sub-member therewithin.

BRIEF DESCRIPTION OF THE DRAWINGS

The accompanying drawings, which are included to provide a further understanding of the disclosure, are incorporated in and constitute a part of this specification, illustrate examples of the disclosure and together with the detailed description serve to explain the principles of the disclosure. No attempt is made to show structural details of the disclosure in more detail than may be necessary for a fundamental understanding of the disclosure and the various ways in which it may be practiced.

DETAILED DESCRIPTION OF THE DISCLOSURE

Figure 1:
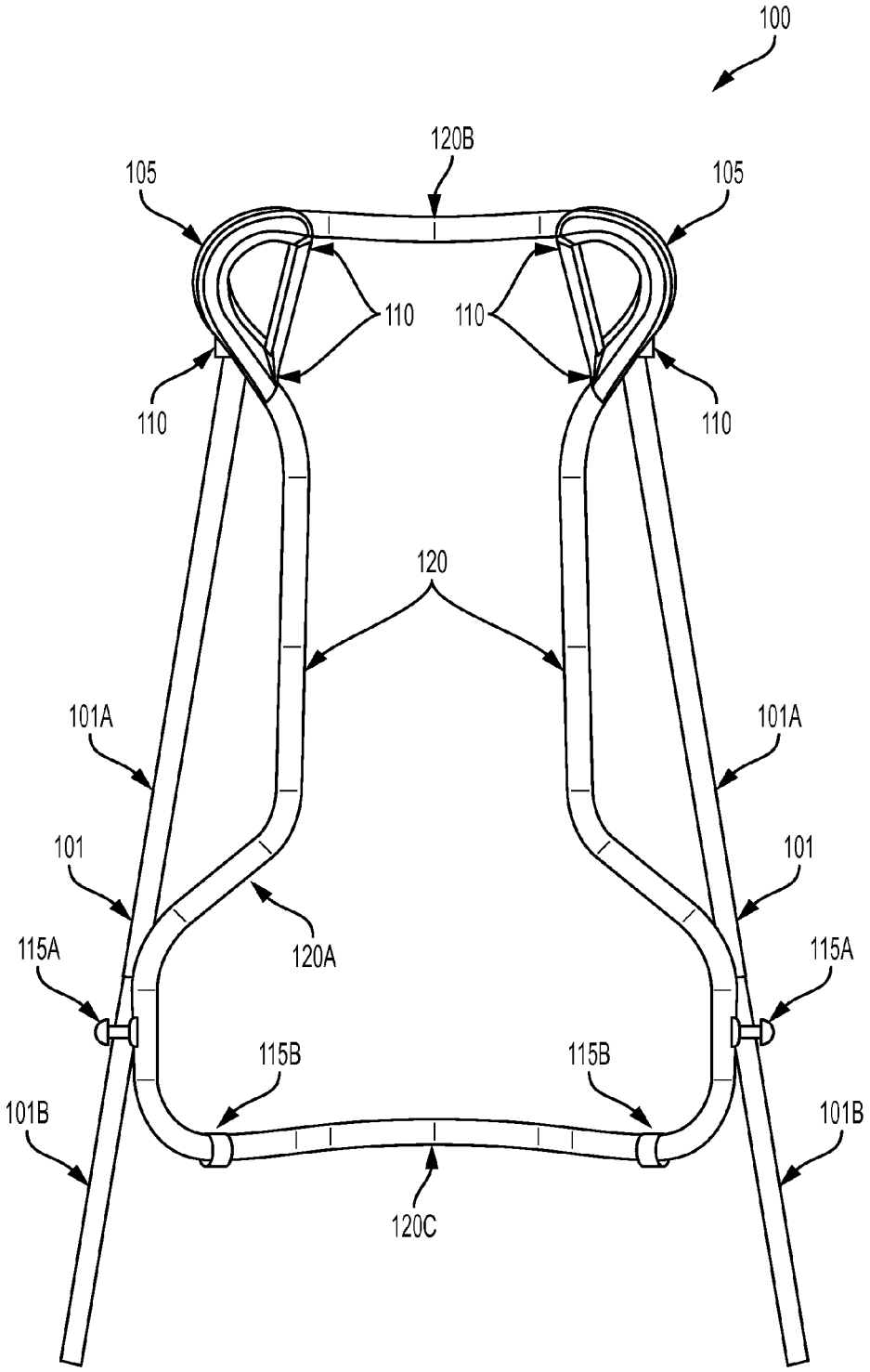
FIG. 1 shows a front view of an example of a frame, constructed according to the principles of this disclosure.

The examples of the disclosure and the various features and advantageous details thereof are explained more fully with reference to the non-limiting examples that are described and/or illustrated in the accompanying drawings, and detailed in the following attached description. It should be noted that the features illustrated in the drawings are not necessarily drawn to scale, and features of one embodiment may be employed with other embodiments as anyone skilled in the art would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples herein should not be construed as limiting the scope of the disclosure, which is defined solely by the appended claims and applicable law. Moreover, it is noted that like reference numerals represent similar parts throughout the several views of the drawings.

The terms "including", "comprising" and variations thereof, as used in this disclosure, mean "including, but not limited to", unless expressly specified otherwise.

The terms "a", "an", and "the", as used in this disclosure, means "one or more", unless expressly specified otherwise.

Although process steps, method steps, or the like, may be described in a sequential order, such processes, and methods may be configured to work in alternate orders. In other words, any sequence or order of steps that may be described does not necessarily indicate a requirement that the steps be performed in that order. The steps of the processes or methods described herein may be performed in any order practical. Further, some steps may be performed simultaneously.

A backpack system is described herein comprising a frame and a pack (e.g., backpack or outdoor pack) that may be used by individuals engaging in different type of events such as hunting, fishing, hiking, camping, sports and the like. The pack may be configured to be readily engaged with the frame. The pack may comprise one or more pocket sections that may be quickly detached for easy access to its contents by a user while still wearing the main part of the pack which may remain engaged with the frame.

Figure 2:
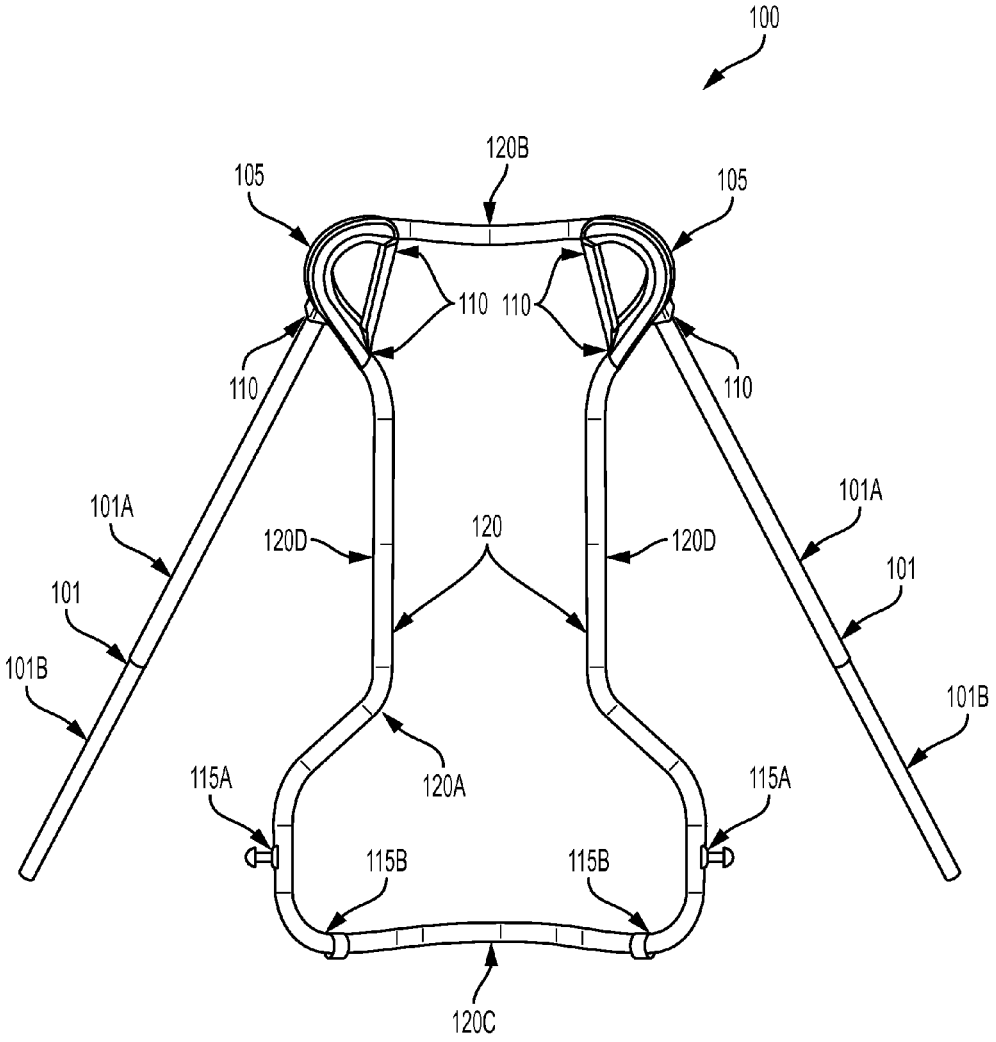
FIG. 2 shows a front view of the frame of FIG. 1 with its back legs extended, constructed according to the principles of this disclosure.
Figure 3:
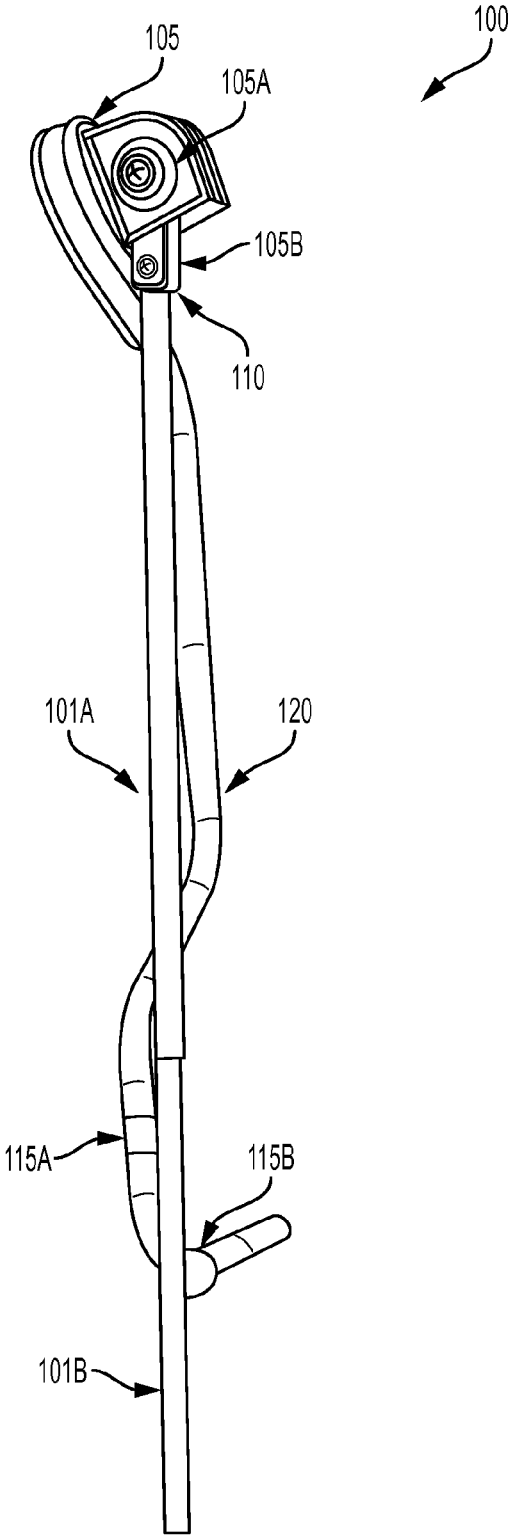
FIG. 3 shows a side view of the frame of FIG. 1, constructed according to the principles of this disclosure.
Figure 4:
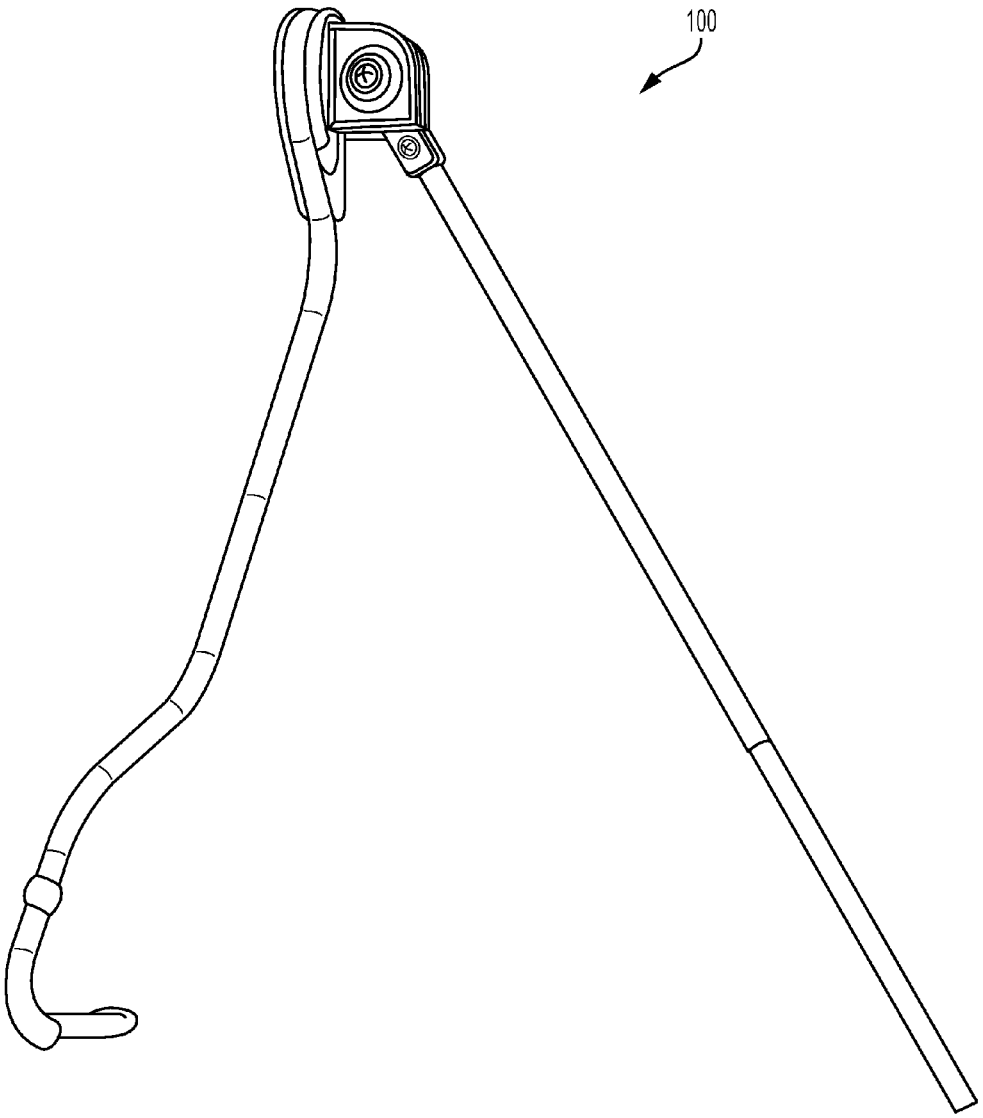
FIG. 4 shows another side view of the frame of FIG. 1 with a leg extended, constructed according to the principles of this disclosure.
Figure 5:
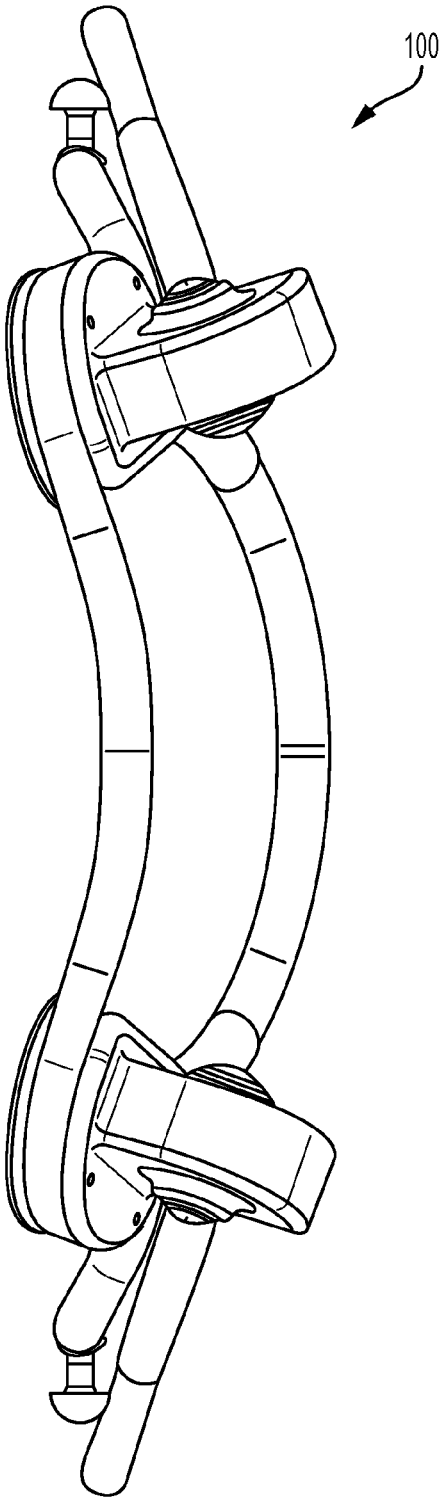
FIG. 5 shows a top view of the frame of FIG. 1, constructed according to the principles of this disclosure.
Figure 6:
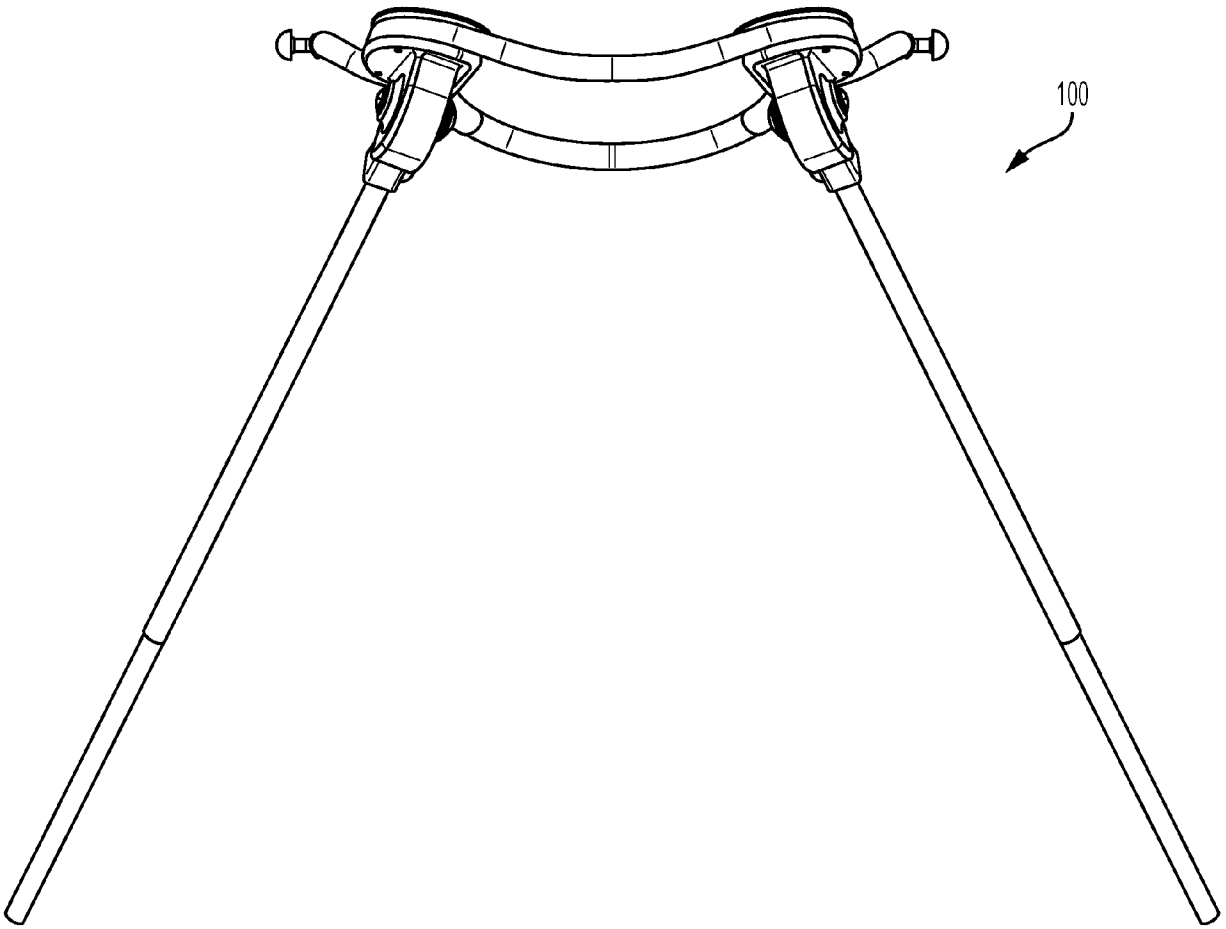
FIG. 6 shows another top view of the frame of FIG. 1 with its legs extended, constructed according to the principles of this disclosure.
Figure 7:
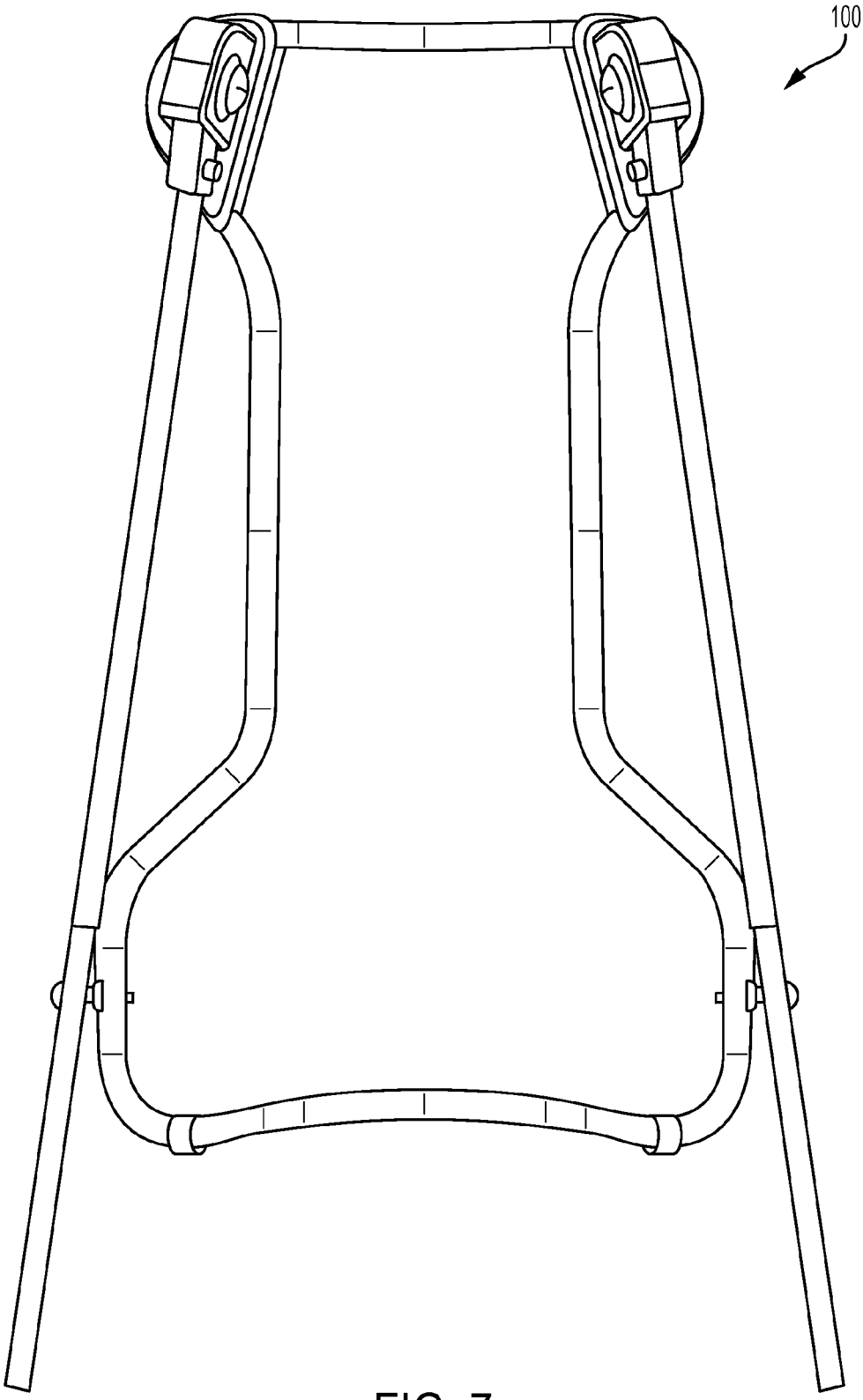
FIG. 7 shows a back view of the frame of FIG. 1, constructed according to the principles of this disclosure.
Figure 8:
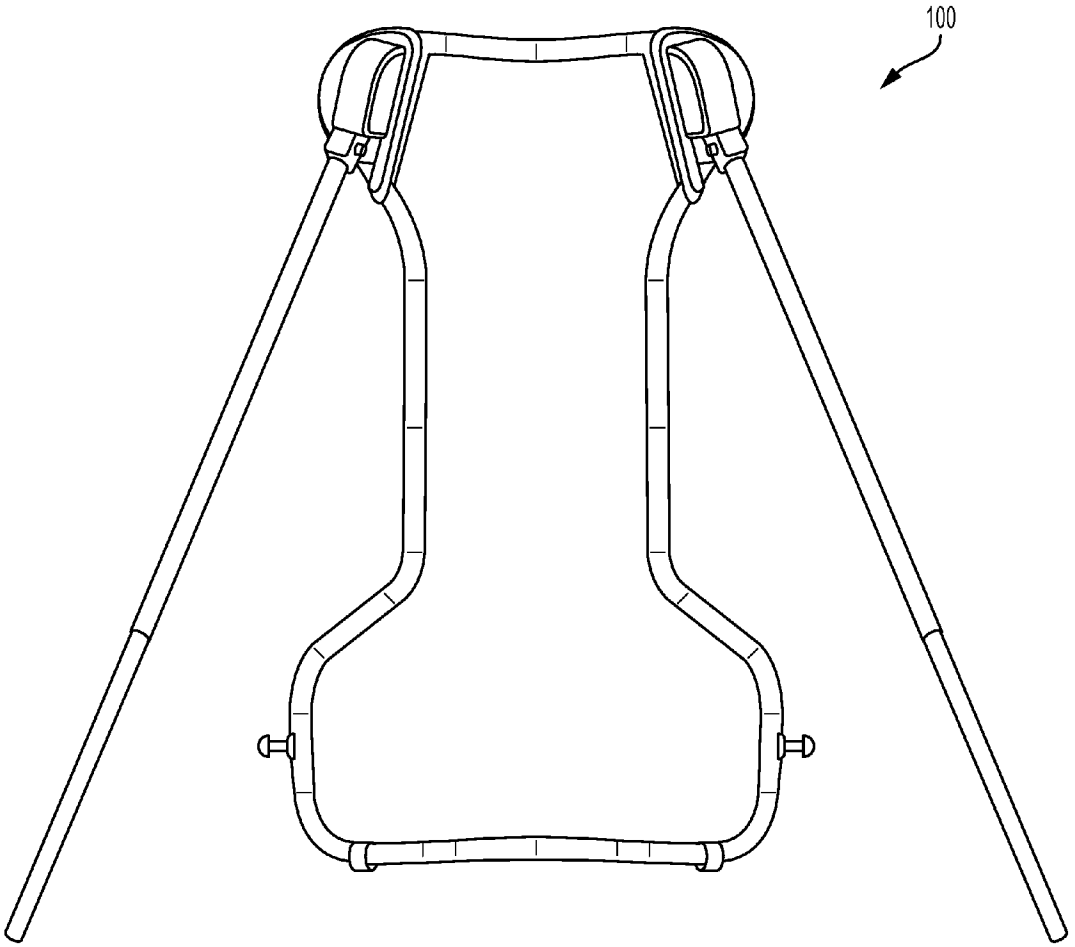
FIG. 8 shows another back view of the frame of FIG. 1 with its legs extended, constructed according to the principles of this disclosure.

Referring first to FIGS. 1-8, various views of a frame 100 is shown for use with a companion pack. For example, FIG. 1 illustrates an example of a front view of the frame 100 having support members 101 (e.g., 101A, 101B) in a compacted position. FIG. 2 is another example of a front view, this time with support members 101 in an angled, extended position, according to principles of the disclosure. FIGS. 3 and 4 show side views of frame 100 in the compacted and extended positions, respectively. FIGS. 5 and 6 are top views of frame 100 in compacted and extended positions, respectively; and FIGS. 7 and 8 are rear views of the frame 100 in compacted and extended positions, respectively.

Figure 9:
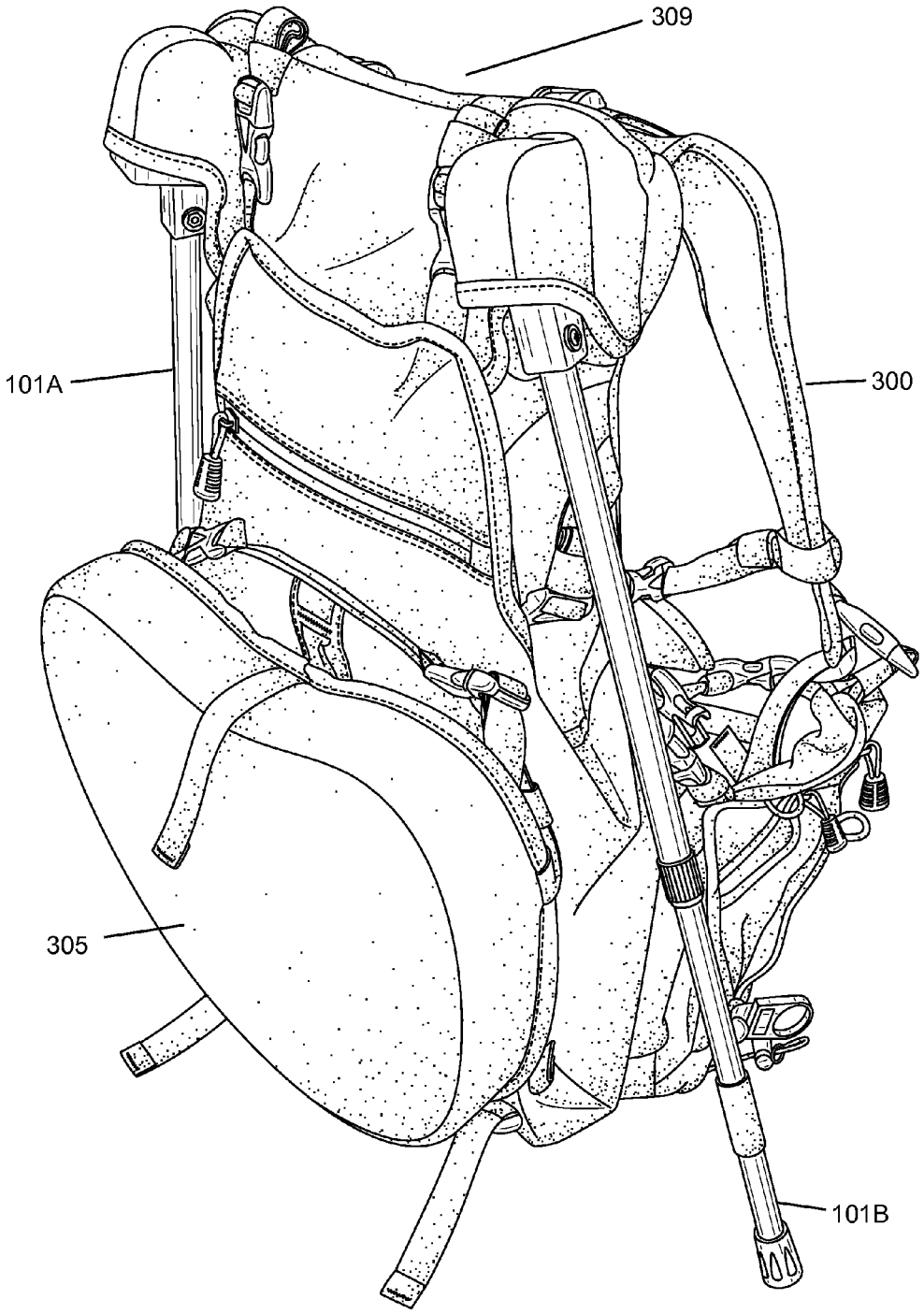
FIGS. 9-15 show various exemplary views of a companion pack configured according to principles of the disclosure, mated with the frame of FIG. 1.
Figure 10:
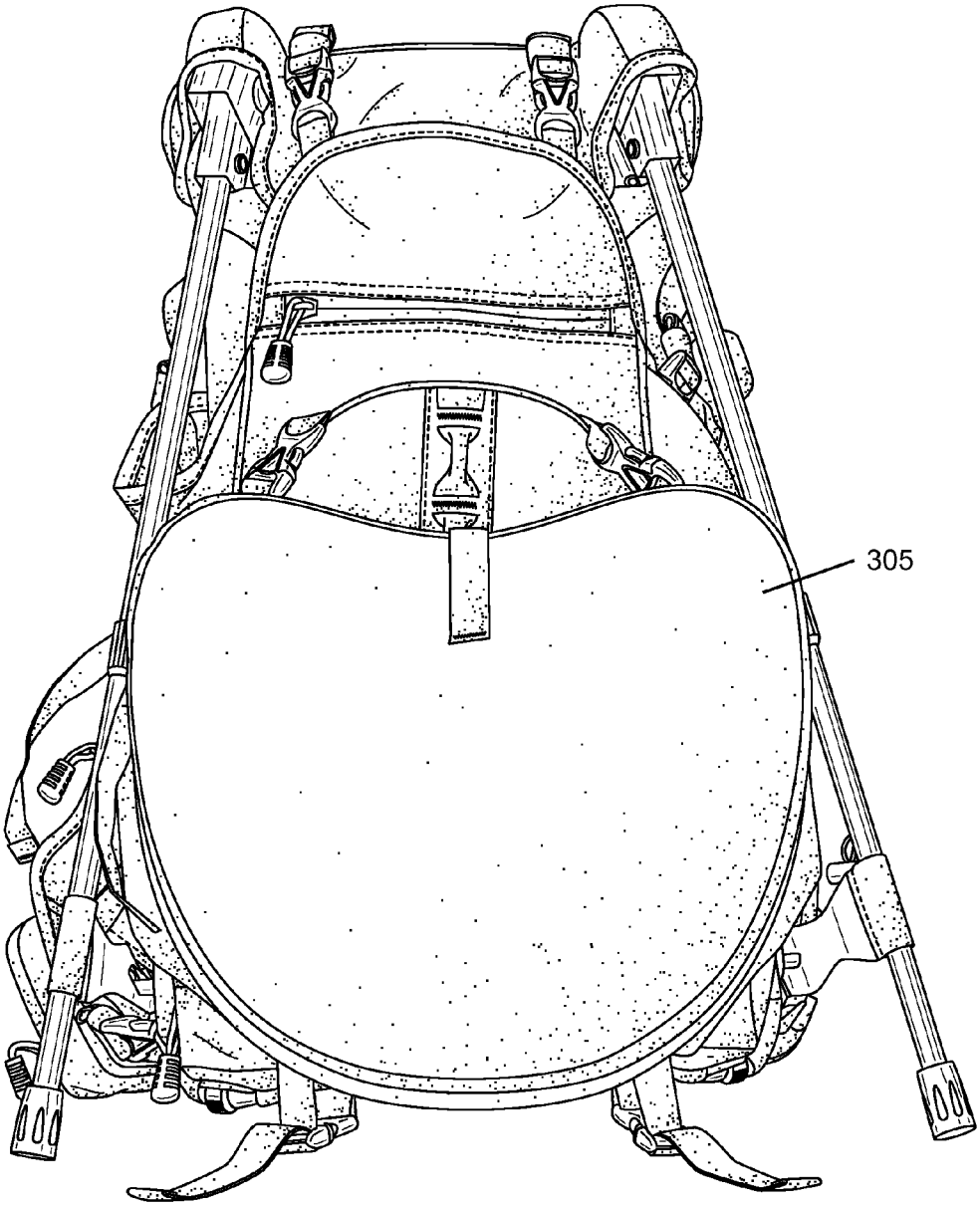

As shown in FIG. 9, for example, frame 100 may be used with an attachable companion pack 300 (as seen, e.g., in FIGS. 9-15) configured according to principles of the disclosure. The companion pack 300 may be configured to store supplies and also support various user postures, such as when hunting.

The frame 100 may comprise a base 120 and at least one support member 101. Where more than one support member is provided, the support members 101 may be configured spaced apart from one another with base 120 interdisposed therebetween, as seen, e.g., in FIG. 1. The base 120 includes a base body that may be formed as a single piece, continuous structure that may be configured with multiple bends to mate with the general curvature of a back-side of a human body. The base body may be configured as multiple separate component sections that may be connected to one another to create the continuous structure. In alternate applications, the base 120 may be configured so that it is dis-continuous. Support member(s) 101 may include a tubular shape, a rod shape, and the like. The support member(s) 101 may include a plurality of telescopic components to allow for adjustable length of the support member 101.

The base body of the base 120 may include a substantially tubular structure, a substantially rod-like structure, or the like. The base 120 may be made of a material, such as, e.g., plastic, metal, carbon-fiber, fiberglass, cloth, foam, wood, a composite material, or the like, or any combination thereof. The base 120 may be configured with top section 120B that extends between two spaced apart brackets 105. The top section 120B may be separated from a bottom section 120C by two opposing substantially parallel sections 120D (as shown in FIG. 2). The bottom section 120C may be wider (or narrower) than the top section 120B. The bottom section 120C may have a larger curvature to match a lower portion of a person's back-side, and may be larger in width as compared with the top section 120B. An angled section 120A may be configured to connect the bottomed section 120C with the parallel sections 120D.

The bracket 105 may be configured with at least one opening 110 which may be configured to connect to a respective support member 101. The opening 110 may include a recess (e.g., a track) that is configured to receive and engage a portion of the base 120, as seen, e.g., in FIG. 1, to secure the bracket 105 to the portion of the base 120. The bracket 105 may also be configured to retain the portion of the base 120 therein. The base 120 may be held in place in or by bracket 120 by compression fitting, by a fastener such as, e.g., a screw or the like, by adhesives such as bond and glue, or similar connecting techniques. The base 120 may be configured to curve along the outside of the bracket 105, for example, in a channel formed on an outer circumference of the bracket 105.

Alternatively, the bracket 105 may be integrally formed with a portion of the base 120.

The bracket 105 may include plurality of fasteners 105A and 105B (as seen in FIG. 3) that may be configured to attach support member 101. The fasteners 105A and 105B may include, e.g., a U-shaped portion, a C-shaped portion, a bracket, a clamp, a pin, or the like. In one aspect, the fasteners 105B may be configured to have a diameter slightly greater than the diameter of the support member 101.

The fastener 105A may be configured to permit the support member 101 to pivot away from (and back to) the base 120 to extend the support member at angle from the base 120 (shown in FIG. 2). The support member(s) 101 may be spring-loaded, perhaps at bracket 105, to cause the leg(s) to self-propel into an extended (away from the base 120) position when released by a user for permitting the frame 100 and associated pack to be supported and to support the user so that the user may be supported against the support member(s) 101. The fastener 105A may comprise a spring-loaded mechanism that assists in propelling the support member 101 away from the base 120, when disengaged from the base 120.

In the closed position, the support member 101 may be held against (or near) the base 120 by a fastener (not shown) such as, e.g., a strap, a loop, a hook, or the like, wherein the fastener may be provided as a part of a companion carry bag mounted to the frame.

The support member(s) 101 may also include a plurality of sub-members, including a first sub-member 101A and a second sub-member 101B. The sub-members 101A and 101B may be telescopically joined, with the sub-member 101A being configured to slidably hold sub-member 101B therewithin. The sub-members 101A and 101B may be locked into an extended configuration as shown in FIG. 1, by means of a fastener (not shown), such as, e.g., a retractable push tab. The sub-members 101A and 101B may include a plurality of fastening positions, so as to allow the user to select a desired overall length of the support member 101. A user may elect to extend or shorten the length of the support member(s) 101, so that in the shortened configuration, the length of the support member(s) 101 is approximately the same as (or less than) a height of the base 120. In the extended position, the support member(s) 101 extend in length to permit the base 120 to be held at a moderate angle so that a person wearing the outdoor pack 100 may lean backwards comfortably, and have a rest support. A cushion or pad 305 (shown in FIG. 10) may be deployed that permits a user to sit upon the ground and rest against the frame of the outdoor pack 100.

The base 120 may comprise a collapsible structure, such as, e.g., two or more sub-members (e.g., tubular members, rods, or the like) telescopically joined together. In some configurations, the sections 120D may be attached to a separate opening 110 of the brackets 105. The base 120, proximate the bottom section 120D, may include a stop or a connecting mechanism 115A (e.g., a clip-on, a button, a rod, or the like) which can be used to hold or align one or more of the support member 101 with respect to the base 120, such as, e.g., close to the base 120 when not in use. The base 120 may further include a clip-on 115B which can be used to attach the companion pack which may include e.g., pockets, pads, or the like.

As described herein, frame 100 may be configured to connect to a backpack, forming a backpack system that provides support to a wearer. FIGS. 9-15 illustrate various views of an example of a pack 300 having frame 100 connected thereto. The pack 300 may include a recessed area (not shown) that is configured to receive the base 120 therein. The recessed area may include an opening (not shown) at the bottom of the pack 300, or at the top of the pack 300, so as to receive the base 120 and securely attach the pack 300 to the base 120.

As shown in FIG. 9, the pack 300 may include at least one pad 305 (such as e.g., shown in FIG. 15) that may be used as e.g., cushion or the like. The pad 305 may be removable. The pad 305 may be attached to the pack by at least one fastener. Either or both the pad 300 and/or the frame 100 may include a magnet which can be used for attachment to one another.

The pack 300 may include a pair of bracket covers 309 (shown in FIG. 9) that may be configured to cover a portion or all of the brackets 105. The bracket covers 309 may be constructed to resist forces that may be exerted by the brackets 105 against the back 309 during use, such as, e.g., when used in the extended position.

Figure 11:
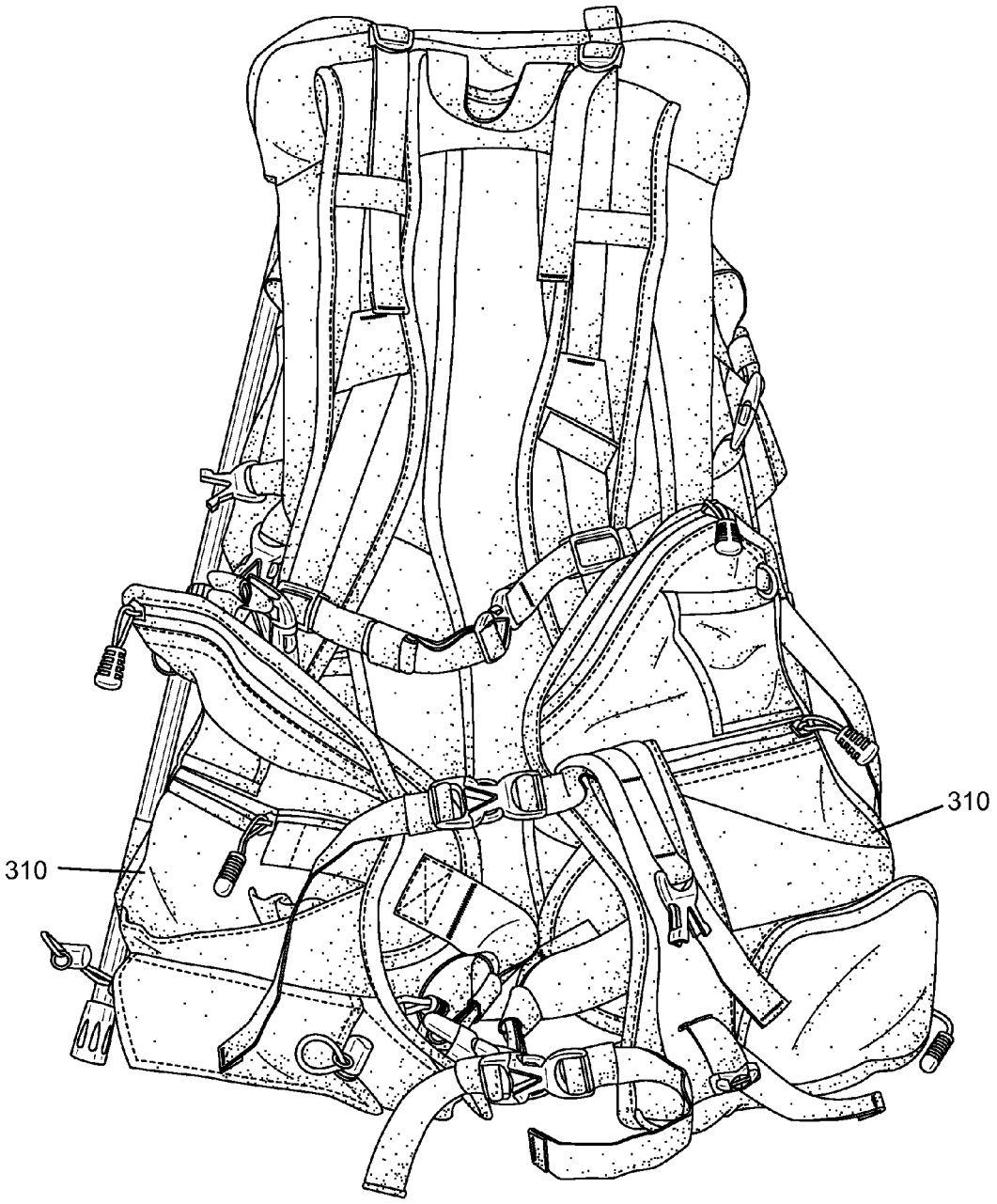
Figure 12:
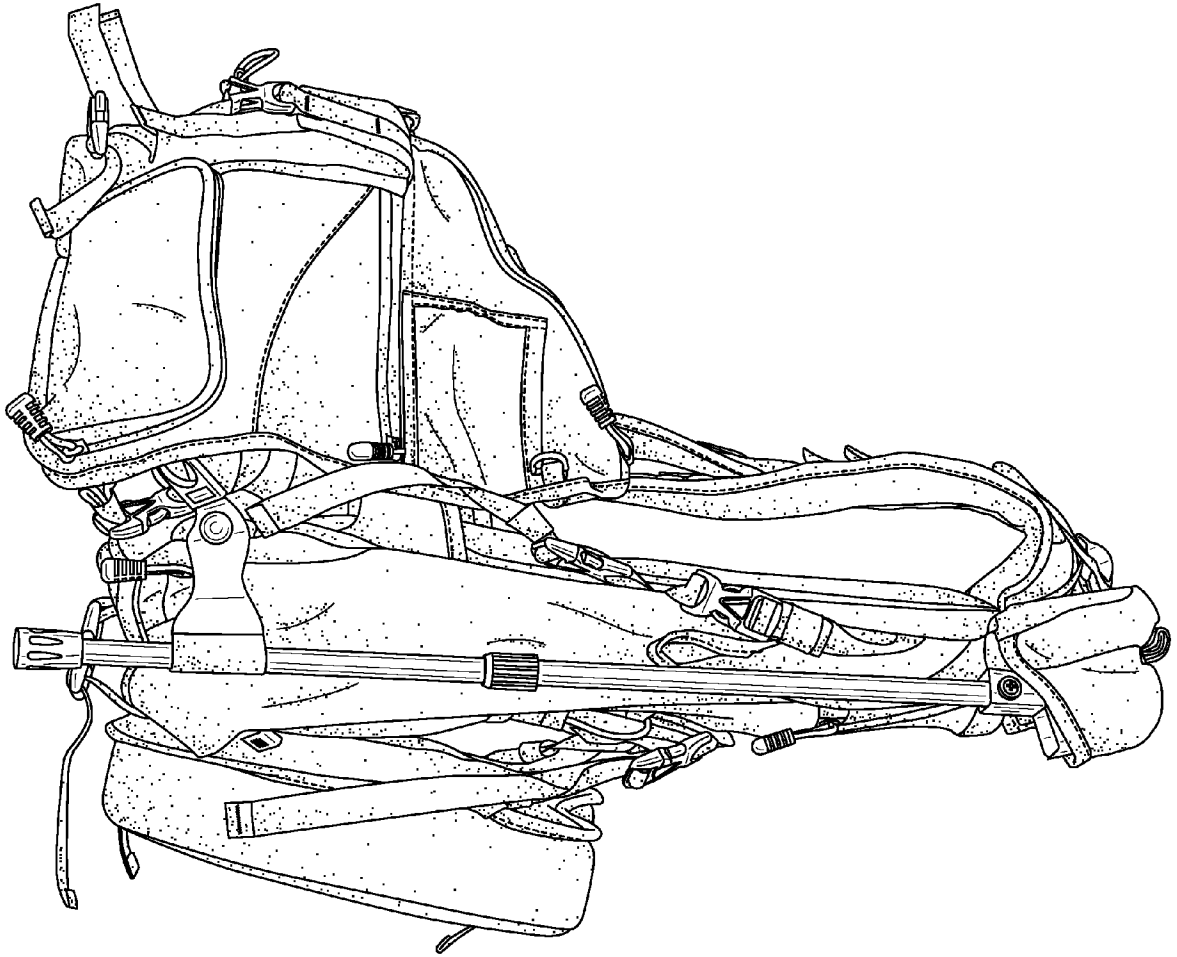
Figure 13:
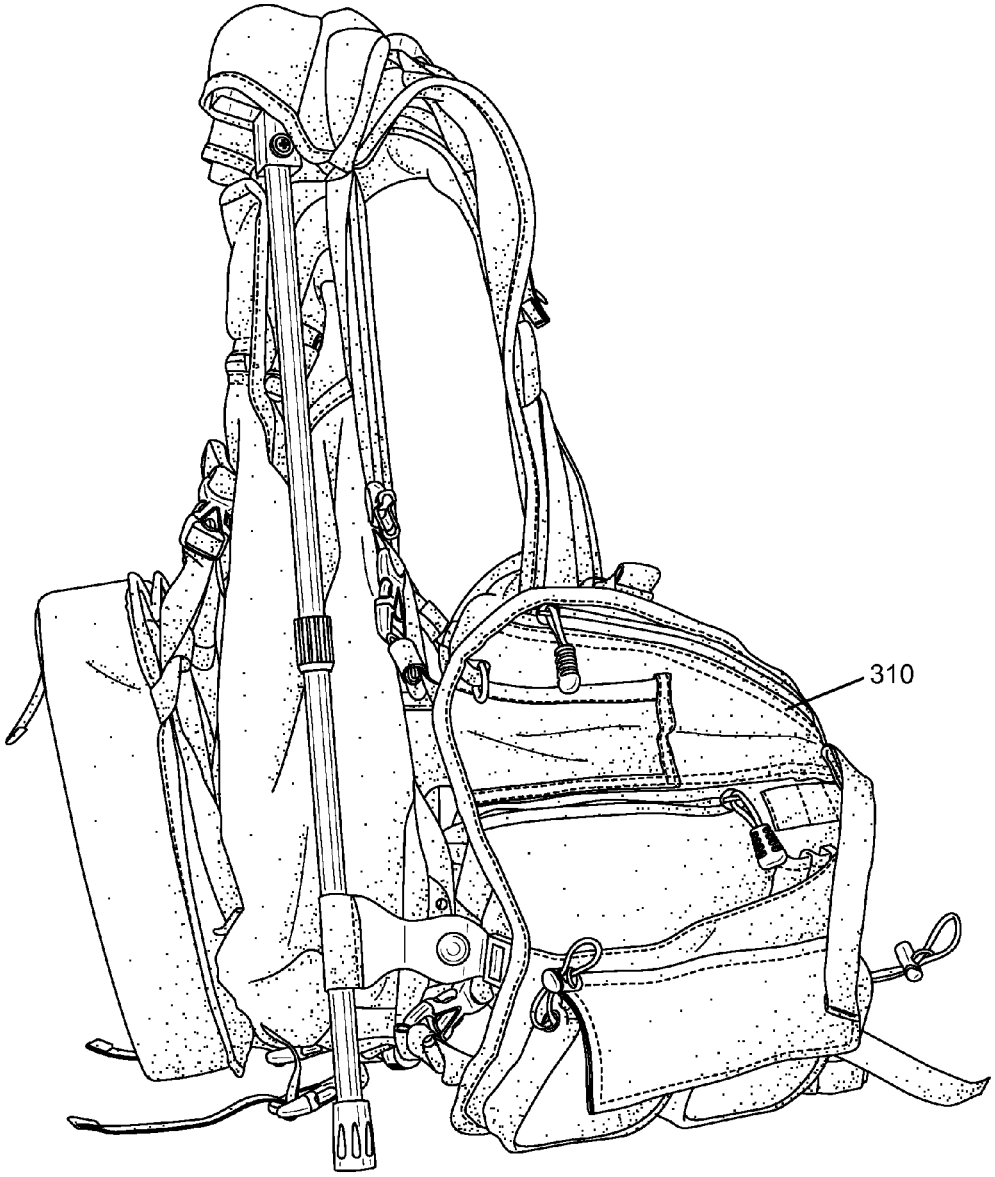
Figure 14:
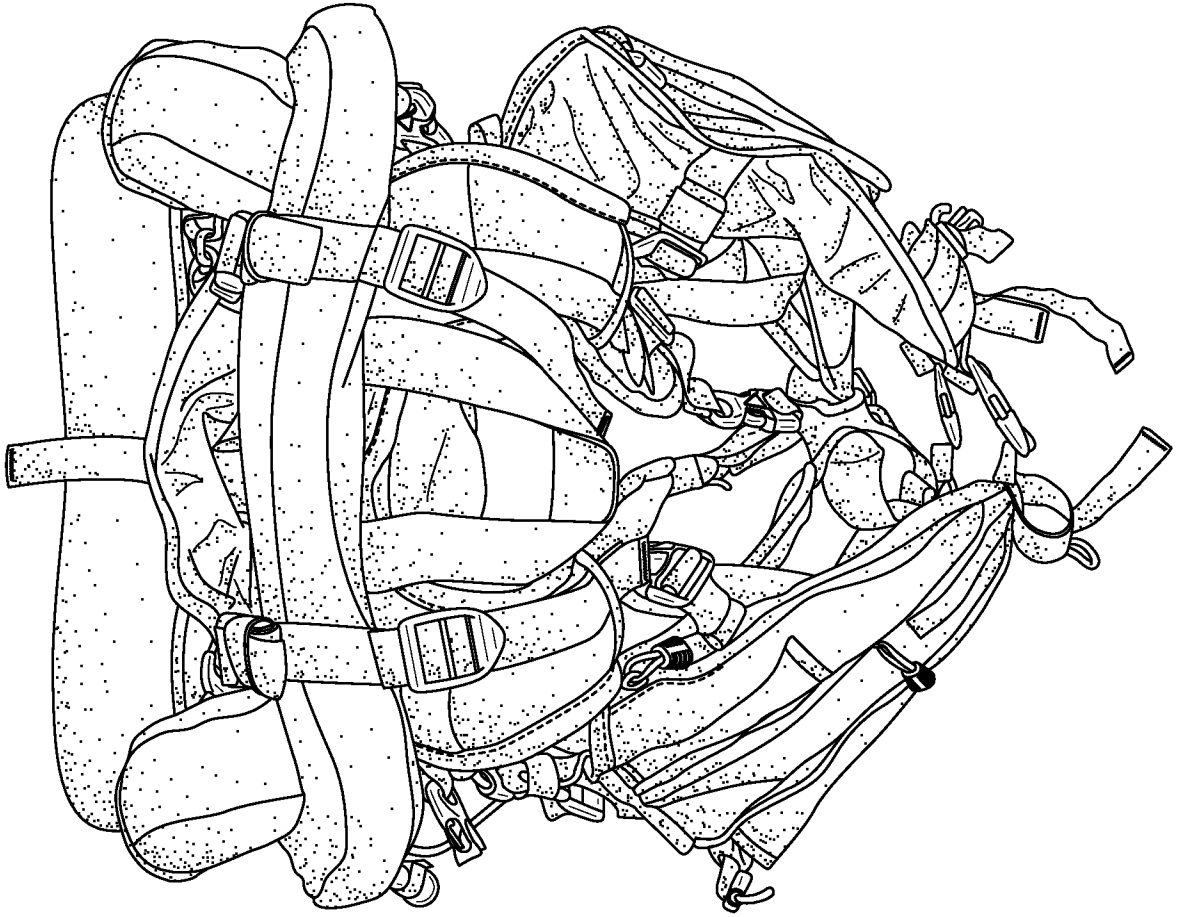
Figure 15:
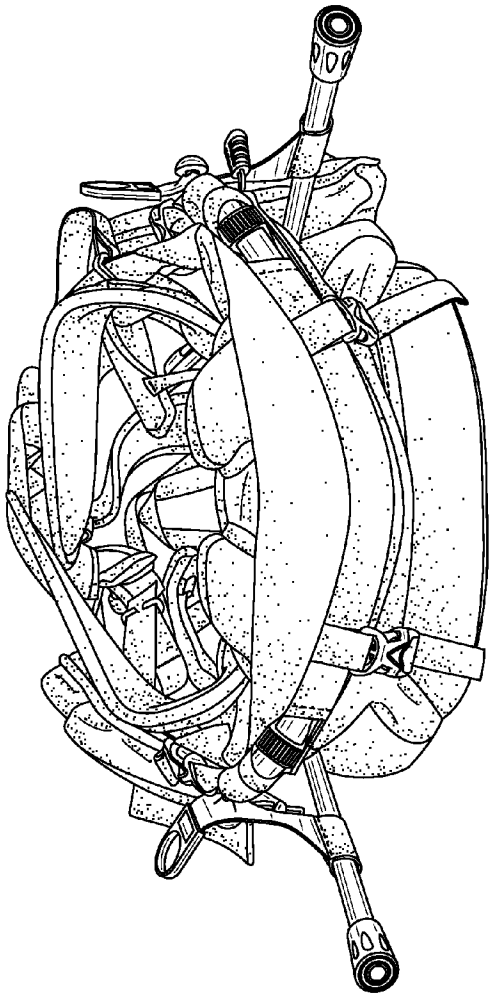

The pack 300 may include at least one removable pocket 310, as shown, for example, in FIGS. 11 and 13, that may be attached to the frame 100 e.g., sides, fronts, back, shoulders, and the like. The pocket 310 may be used to carry e.g., hunting gears, food, ammunition, hunted animal, water bottle, and any other supplies. The pocket 310 may also contain a colored flag or a cloth for signaling and safety purposes. The companion outdoor pack 300 or pockets 310 may be attached to the frame 100 by at least one fastener (not shown) which may include e.g., push-buttons, adhesives, pins, bolts, screws, nuts, clips, clamps, rivets, hook-and-loops, tongue-and-groove, or the like.

The pockets may also include multiple smaller pockets both on the outside and the inside. In case of multiple pockets, the pockets may be attachable to each other with the same fastener used in attaching to the outdoor pack 100. The fastener may be adjustable in length and width as to accommodate the size of a person wearing the outdoor pack 100.

It is contemplated that the pocket 310 and the removable pad 305 may be made of materials such as e.g., polyester, wool, polyurethane, cloth, fabrics, canvas, foam, insulating material, carbon fiberglass, metal, carbon fiber, or any suitable weatherproof material.

While the present disclosure has been described in terms of exemplary embodiments, those skilled in the art will recognize that the present disclosure can be practiced with modifications in the spirit and scope of the appended claims. These exemplary embodiments given above are merely illustrative and are not meant to be an exhaustive list of all possible designs, embodiments, applications, or modifications of the present disclosure.

What is claimed is:

1. A backpack system, comprising:

a backpack that includes a storage section and a bracket cover; and a portable frame, comprising:

a tubular base having a top section separated from a bottom section by two opposing side sections, the top section joined to each side section at a curved corner section, the bottom section having a curvature between its ends, and an overall width of the bottom section being wider than an overall width of the top section;

an adjustable support member; and a bracket that secures a portion of the adjustable support member to the base, the bracket comprising a channel formed on an outer circumference of the bracket wherein a curved corner section of the tubular base is received in and curves along the channel, and wherein the base and adjustable support member are configurable between a compacted position and an extended position to provide a user with selectable support.

2. The backpack system of claim 1, wherein the portable frame comprises two support members, the support members being spaced apart from one another with the base interdisposed therebetween.

3. The backpack of claim 1, wherein the at least one support member comprises a tubular member.

4. The backpack system of claim 1, wherein the at least one support member comprises a first sub-member and a second sub-member, the first sub-member and the second sub-member being telescopically joined, wherein the first sub-member slidably holds the second sub-member therewithin.

5. The backpack system of claim 1, wherein the at least one adjustable support member is adjustable to an extended position, the extended position causing the base to be held at a moderate angle to provide a rest support for a wearer of the backpack system.

6. A backpack system, comprising:

a backpack having one or more storage sections; and a portable frame removably attachable to the backpack, the portable frame comprising a at least one adjustable support member and a tubular base having a top section separated from a bottom section by two opposing side sections, the top section joined to each side section at a curved corner section, the bottom section having a curvature between its ends, and an overall width of the bottom section being wider than an overall width of the top section, the portable frame comprising a bracket having a channel formed on an outer circumference of the bracket, a curved corner section of the tubular base is received in an curves along the channel.

7. The backpack system of claim 6, wherein the portable frame comprises two support members, the support members being spaced apart from one another with the base interdisposed therebetween.

8. The backpack of claim 6, wherein the at least one support member comprises a tubular member.

9. The backpack system of claim 6, wherein the at least one support member comprises a first sub-member and a second sub-member, the first sub-member and the second sub-member being telescopically joined, wherein the first sub-member slidably holds the second sub-member therewithin.

10. The backpack system of claim 6, wherein the at least one adjustable support member is adjustable to an extended position, the extended position causing the base to be held at a moderate angle to provide a rest support for a wearer of the backpack system.

11. The backpack system of claim 6, wherein the base comprises a collapsible structure comprised of two or more sub-rods telescopically joined together.

12. The backpack system of claim 6, wherein the backpack comprises at least one removable pocket, the at least one removable pocket being attachable to the portable frame.

13. The backpack system of claim 6, wherein the backpack comprises at least one removable pad, the removable pad being attachable to the backpack with at least one fastener.

14. The backpack system of claim 9, further comprising:

a fastening member, the fastening member connecting the first sub-member and the second sub-member, the fastening member being configured to adjust a length of the at least one support member.

15. The backpack system of claim 6, wherein the at least one support member is configured to hold the base in an upright position relative to the ground.

16. The backpack system of claim 6, wherein the at least one support member is adjustable to different angles.

17. A frame for a backpack system, comprising:

a tubular base having a top section separated from a bottom section by two side sections, the bottom section having a curvature and the top section having a curvature, the curvature of the bottom section being larger than the curvature in the top section, the top section joined to each side section at a curved corner section;

a bracket having a channel formed on an outer circumference of the bracket, a curved corner section of the tubular base is received in and curves along the channel; and at least one adjustable support member, wherein the at least one adjustable support member is projectable substantially downward and rearward from the base and is attachable to the bracket.

18. The frame of claim 17, further comprising two support members, the support members being spaced apart from one another with the base interdisposed therebetween.

19. The frame of claim 17, wherein the at least one support member comprises a tubular member.

20. The frame of claim 17, wherein the at least one support member comprises a first sub-member and a second sub-member, the first sub-member and the second sub-member being telescopically joined, wherein the first sub-member slidably holds the second sub-member therewithin.

21. The backpack system of claim 1, wherein the bottom section has a curvature and the top section has a curvature, the curvature of the bottom section being larger than the curvature in the top section.

22. The backpack system of claim 6, wherein the bottom section has a curvature and the top section has a curvature, the curvature of the bottom section being larger than the curvature in the top section.

23. The frame of claim 17, wherein the bottom section is wider than the top section.

24. The backpack system of claim 1, wherein the bottom section has two opposing substantially parallel straight portions located at opposite ends, wherein the two opposing substantially parallel sections separating the top section from the bottomed section is longer than the two opposing substantially parallel straight portions.

* * * * *